US006425685B1

(12) United States Patent
Chuan

(10) Patent No.: US 6,425,685 B1
(45) Date of Patent: Jul. 30, 2002

(54) PROCESS FOR RECLAIMING SALVAGED ASPHALT

(76) Inventor: Chen Po Chuan, No. 17, Sheng-Ping Street, Taichung City (TW)

( * ) Notice: Subject to any disclaimer, the term of this patent is extended or adjusted under 35 U.S.C. 154(b) by 92 days.

(21) Appl. No.: 09/619,705

(22) Filed: Jul. 19, 2000

(51) Int. Cl.[7] ..... B28C 5/46; F27B 7/10; F27B 13/12

(52) U.S. Cl. ..... 366/4; 366/25; 432/107; 432/112; 110/246; 34/137

(58) Field of Search ..... 366/4, 6, 7, 12, 366/13, 14, 15, 22, 23, 24, 25, 54, 2; 432/110, 106, 112, 113, 107, 103; 34/134–135, 136, 137, 138, 139; 110/246

(56) References Cited

U.S. PATENT DOCUMENTS 2,158,689 A * 5/1939 Buchanan ..... 432/112
4,191,530 A * 3/1980 Bearce ..... 432/112
5,083,870 A * 1/1992 Sindelar et al. ..... 366/25
5,088,856 A * 2/1992 Yocum ..... 110/246
5,205,225 A * 4/1993 Milsap, III ..... 432/112
5,303,999 A * 4/1994 Nath et al. ..... 366/25
5,305,533 A * 4/1994 Alexander et al. ..... 432/107
5,338,188 A * 8/1994 Yocum ..... 110/246
5,562,053 A * 10/1996 Lim ..... 432/107
6,110,430 A * 8/2000 Swisher et al. ..... 110/226

* cited by examiner

*Primary Examiner*—Tony G. Soohoo
(74) *Attorney, Agent, or Firm*—Bacon & Thomas

(57) ABSTRACT

A process for reclaiming salvaged asphalt includes feeding salvaged asphalt mixed with new sands, stones and tar in a designed proportion into a double-layer drying machine including inner and outer gyroscopic drums; indirectly heating the salvaged asphalt in the drying machine by using a plurality of burners disposed externally to dry the salvaged asphalt, the heat thus generated being recycled via a draft tube into the drying machine to further heat the salvaged asphalt until the tar in the mixture starts to soften at about 80° C.; and mixing the salvaged asphalt with tar to form rejuvenated asphalt product when they travel to the outer gyroscopic drum in which the temperature reaches and the temperature of the stones contained in the salvaged asphalt also reaches a temperature of 160° C. for fusion with the tar.

2 Claims, 7 Drawing Sheets

PROCESS FOR RECLAIMING SALVAGED ASPHALT

BACKGROUND OF THE INVENTION (a) Field of the Invention

The present invention relates to a process for reclaiming salvaged asphalt, more particularly to an asphalt reclaiming process in which the salvaged asphalt is heated indirectly, the heat being regenerated to perform secondary heating, and is mixed with new sands, stones and tar added in a designed proportion.

(b) Description of the Prior Art

In conventional processes for making asphalt and for reclaiming salvaged asphalt, two sets of costly equipment and complicated processing steps have to be employed. The process for reclaiming salvaged asphalt is even more complicated.. The conventional processes for making asphalt and for reclaiming salvaged asphalt are briefly described as follows:

(1) In the conventional asphalt making process, the steps include feeding, direct heating, screening, and mixing with tar. In the step of direct heating, a burner 11 disposed inside a drying machine 1 (see FIG. 1) has to be fired to about 1200° C. in order to instantly heat the mixture of stones and sands to above 155° C. and, after screening, mix it with tar. The internal structure of the drying machine 1 is a single-layer gyroscopic drum 12. The body of the burner 11 is a piece of complicated high heat efficiency machinery, which is costly, and the heat released thereby is high. However, the released heat cannot be regenerated, and the waste gas thus produced is relatively considerable and should be appropriately controlled so as not to create air pollution.

(2) In the conventional process for reclaiming salvaged asphalt, the steps include feeding, indirect heating, and mixing proportionally with new asphalt product. In the indirect heating step, a drying machine 2 (see FIG. 2) is used. The interior of the drying machine 2 is also a single-layer gyroscopic drum 23 having a hot air generating machine 22 connected to a burner 21. The temperature generated can only heat the salvaged asphalt to below 80° C., and is unable to heat the salvaged asphalt mixed with stones and sands to a normal temperature of about 155° C. Even if 155° C. can be attained, the residual tar content in the salvaged asphalt will reach its burning point and start burning. This is the reason why indirect heating is used. The rate of reclamation of salvaged asphalt to form reclaimed asphalt product using the above-described conventional process is only 30%~50%, which is very low. Besides, the salvaged asphalt has to be proportioned with new asphalt product before mixing therewith. In more concrete terms, in asphalt reclamation projects, two sets of equipment, one for making new asphalt product, the other for reclaiming salvaged asphalt, have to be used, which is especially costly in view of the low reclamation rate. Besides, the quality of the reclaimed asphalt product is inferior to that of new asphalt product. How to enhance the asphalt reclamation rate and the quality of the reclaimed product while lowering manufacturing costs and simplifying the process steps as well as avoiding environmental pollution is the major topic the present invention aims to study.

SUMMARY OF THE INVENTION

A primary object of the present invention is to provide a process for reclaiming salvaged asphalt including the steps of feeding salvaged asphalt mixed with new sands, stones and tar in a designed proportion into a double-layer drying machine including inner and outer gyroscopic drums; indirectly heating the salvaged asphalt in the drying machine by using a plurality of burners disposed externally to dry the salvaged asphalt, the heat thus generated being recycled via a draft tube into the drying machine to further heat the salvaged asphalt until the tar in the mixture starts to soften at about 80° C.; and mixing the salvaged asphalt with tar to form rejuvenated asphalt product when they travel to the outer gyroscopic drum in which the temperature reaches and the temperature of the stones contained in the salvaged asphalt also reaches a temperature of 160° C. for fusion with the tar.

Another object of the present invention is to provide a process for reclaiming salvaged asphalt, in which the heat generated by the burners are recycled via a draft tube into the double-layer drying machine so that the burners do not need to perform instant heating. Recycling of the heat energy assists the burners to attain the temperature required to reclaim salvaged asphalt. By virtue of the process of the present invention, equipment costs can be reduced; the rate of asphalt reclamation can be raised to 100%; the quality of the rejuvenated asphalt product is satisfactory; and environmental requirements can also be met.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
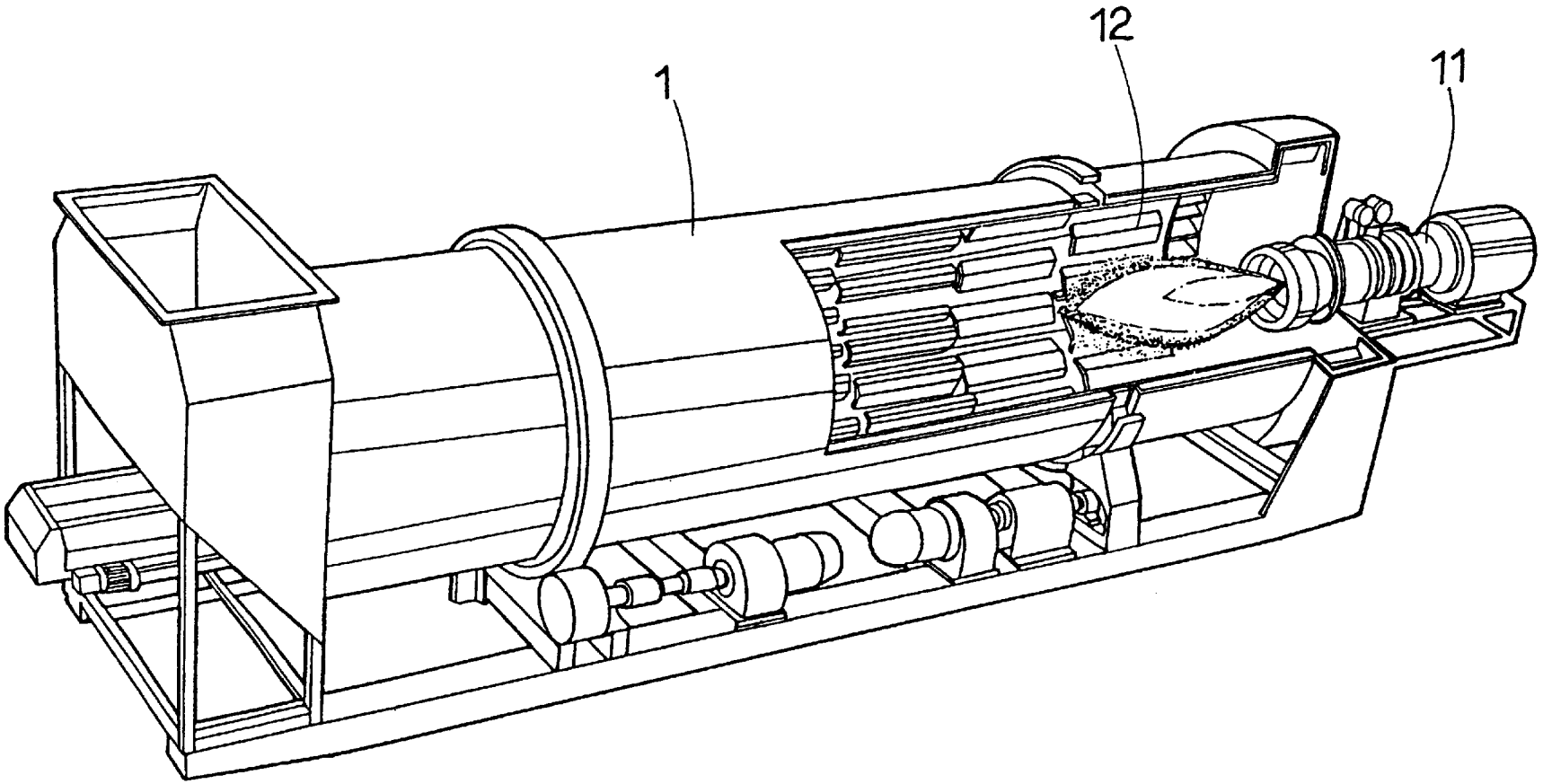
FIG.1 PRIOR ART
FIG. 1 is a sectional perspective view of a conventional drying machine having burners disposed inside, used in the prior art process for reclaiming salvaged asphalt.
Figure 2:
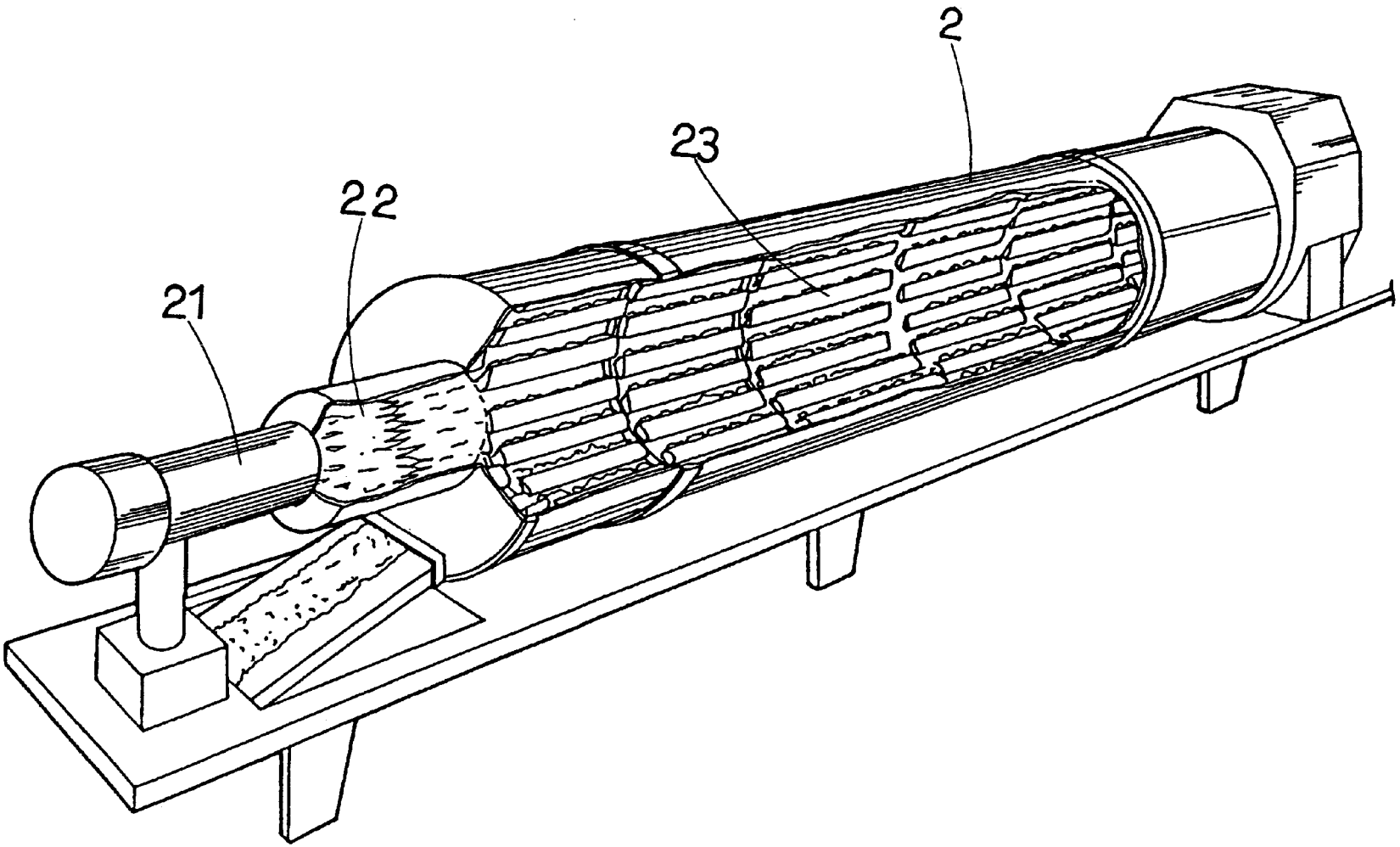
FIG. 2 is a sectional perspective view of the drying machine used in the prior art process.

With reference to FIGS. 4 to 7, the process for regenerating salvaged asphalt according to the present invention includes the following steps:

(A) Feeding a mixture of salvaged and new asphalt materials: According to the proportion of stones, sands and tar in new asphalt product, a certain proportion of parts of new sands, stones, and tar to be added to a mixture of asphalt salvaged from roads and salvaged construction materials (mixtures containing sand, stones, water moisture, tar, etc.) is calculated; the proportionally added materials are mixed with the salvage; and the mixture is transported via a conveyor belt 4 to a feed port 31 of a double-layer drying machine 3;

(B) External indirect heating and baking: After the mixture has entered a gyroscopic drum 32 constituting the inner layer of the double-layer drying machine 3, a plurality of burners 6 disposed outside the drying machine 3 are used to heat the mixture indirectly to get rid of the moisture content in the mixture; by using the burners 6 to heat the outside of the drying machine 3 to indirectly conduct the heat to the inside of the drying machine 3, the tar contained in the mixture is prevented from reaching its burning point;

(C) Recovering heat energy and heating: the heat generated during indirect heating is discharged through a discharge outlet 35 and is recovered by means of a draft tube 5 to be introduced once again into the drying machine 3 via. a heat energy inlet 36 at the other end to heat the mixture, the tar in the mixture beginning to soften after a temperature of about 80° C. has been reached;

(D) Mixing salvaged asphalt and new materials: When the salvaged asphalt and the softened tar travel to the outer gyroscopic drum 33, the burner 6 has been heated to 160° C. so that the sands and stones contained in the salvaged asphalt in the outer gyroscopic drum 33 also reach 160° C. to be able to fuse with the liquefied tar to form rejuvenated or new asphalt product.

Figure 3:
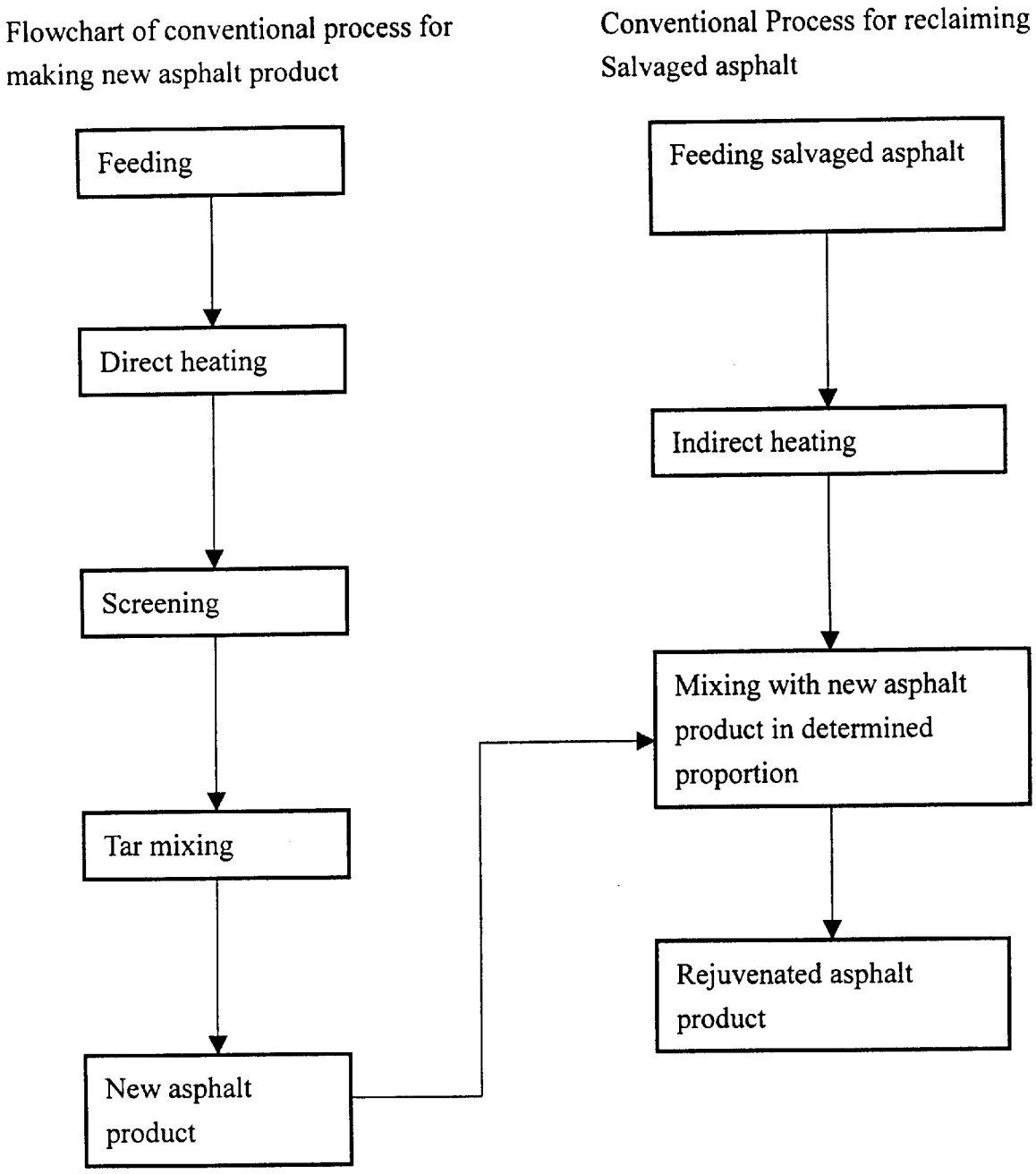
FIG. 3 is a flow chart of the prior art process.
Figure 4:
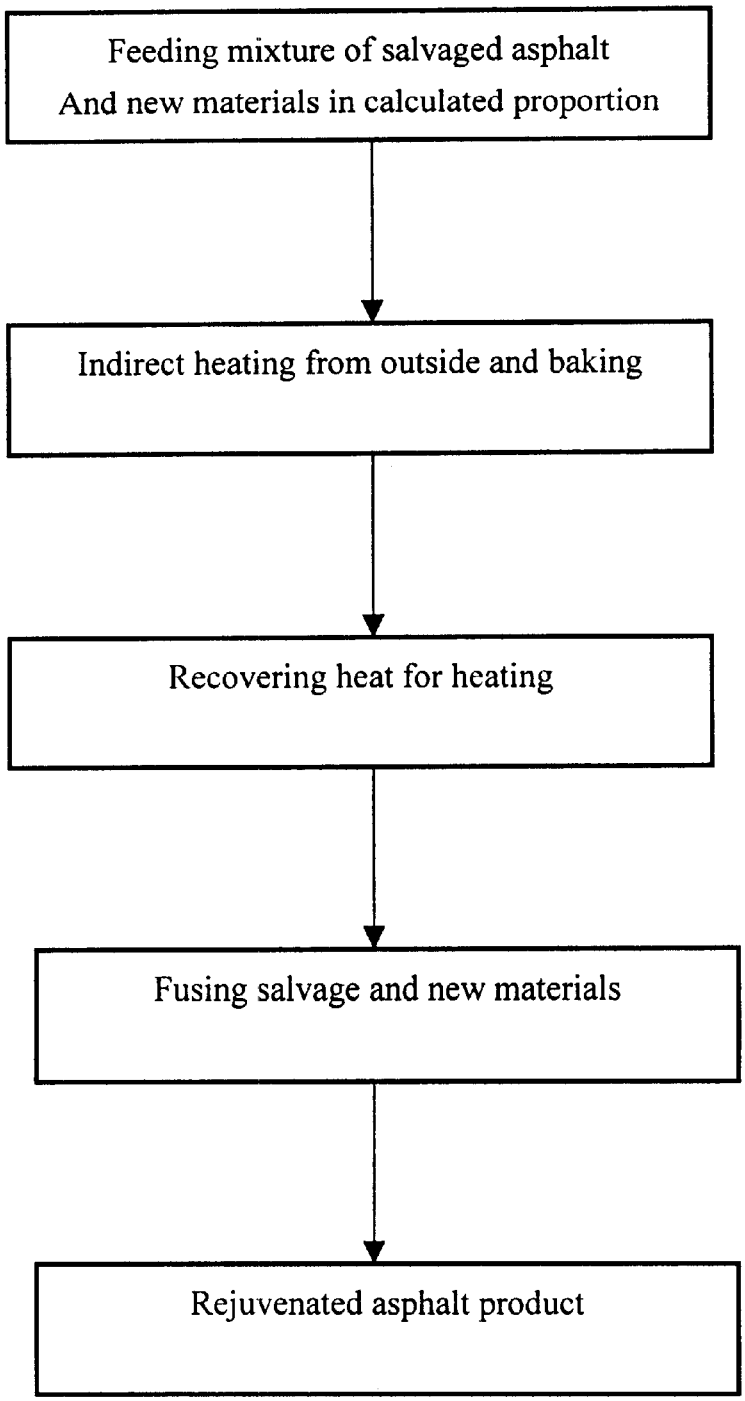
FIG. 4 is a flow chart of the process according to the present invention.
Figure 5:
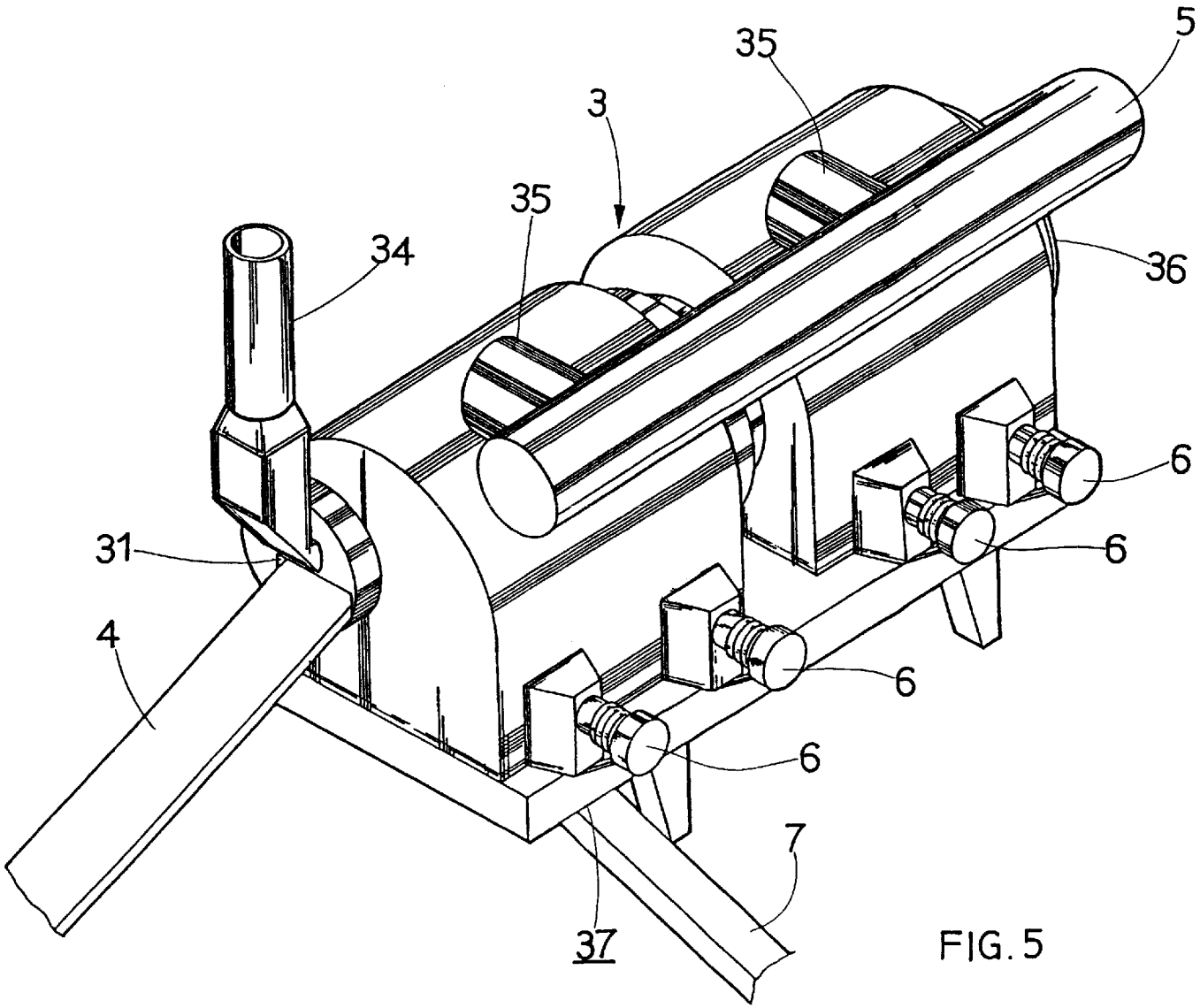
FIG. 5 is a perspective view of a double-layer drying machine according to the present invention.
Figure 6:
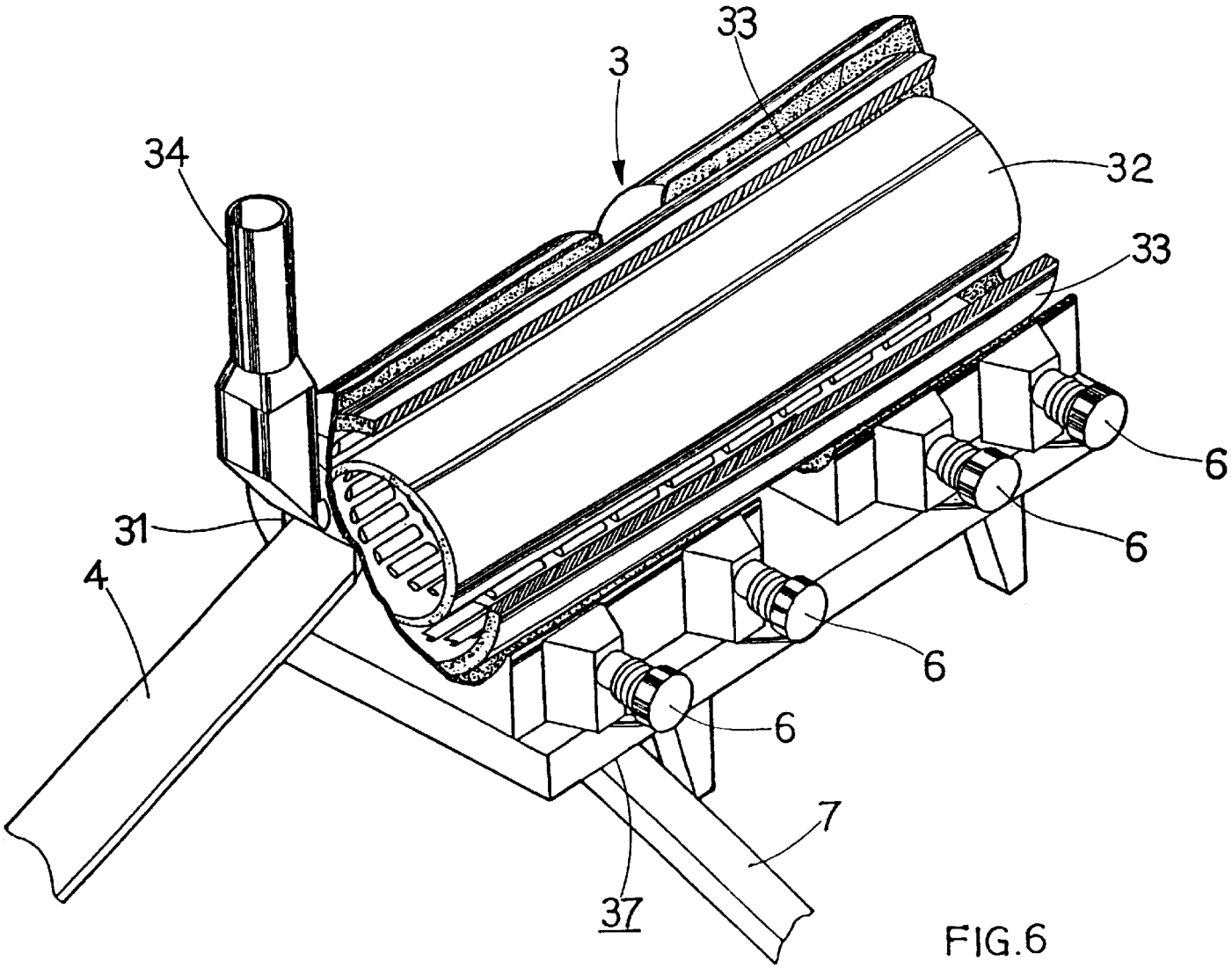
FIG. 6 is a perspective sectional view of the drying machine according to the present invention.

The process and apparatus according to the present invention are characterized in that: salvaged asphalt can be obtained from scraped road materials or salvaged construction materials or all kinds of salvaged sands and stones. Through initial decomposition and analysis, salvaged asphalt contains sands, stones, water moisture and a small amount of oil containing tar. Since the raw materials for making new asphalt product are mixed in a fixed or determined proportion, adding new materials in calculated proportion to the salvaged asphalt achieves a salvaged asphalt mixture having a proportion of materials in the same proportion as new asphalt product. After the complementary materials have been added to the salvaged asphalt, the mixture is fed into the double-layer gyroscopic drying machine 3. As shown in FIGS. 5 and 3, the interior of the drying machine 3 includes outer and inner gyroscopic drums 32, 33, and the exterior is provided with the heat energy discharge port 35, the draft tube 5, the heat energy inlet 36, an exhaust discharge port 34, and a plurality of burners 6.

Figure 7:
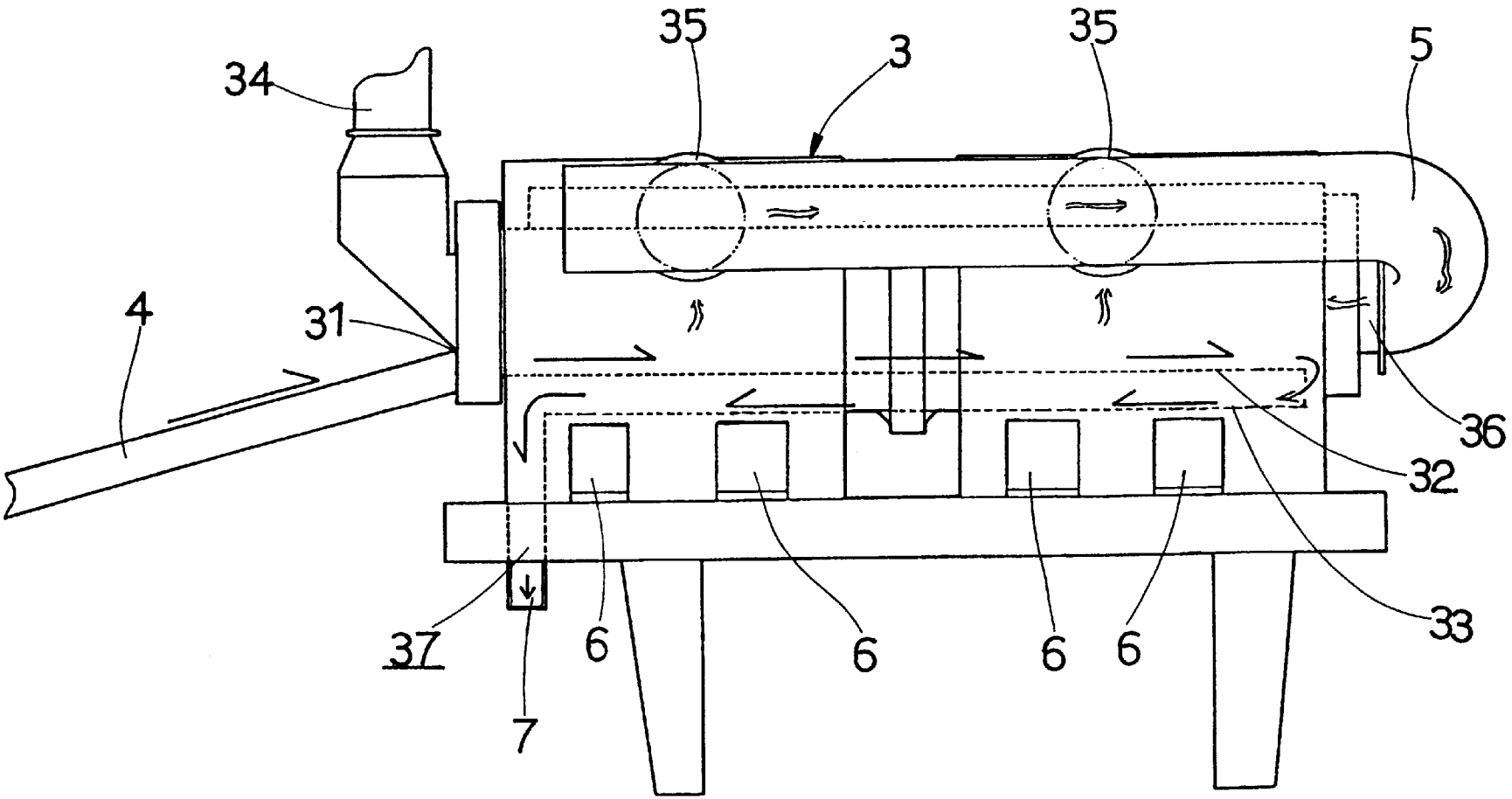
FIG. 7 is a plan view illustrating operation of the drying machine according to the present invention.

It can be seen from FIG. 7 that when the salvaged asphalt enters the drying machine 3, it firstly advances to the inner gyroscopic drum 32, and the burners 6 on the outside are used to indirectly bake the salvaged asphalt in the inner gyroscopic drum 32 so that the water content thereof is lowered. At this time, the heat generated is discharged via the heat energy discharge portion 35 to the draft tube 5 for collection thereby for recycling into the heat energy inlet 36. The recovered heat energy heats the salvaged asphalt in the inner gyroscopic drum 32 to about 80° C. so that the tar contained in the salvaged asphalt and the new materials starts to soften (excessive high heat will cause the tar to burn and is therefore not good for mixing). When the salvaged asphalt travels to the outer gyroscopic drum 33, the burners 6 raise the temperature to about 160° C. so that the stones contained in the salvaged asphalt and the new materials also reach a temperature of about 160° C. (since stones will fuse with tar at about 155 ° C.) and the tar starts to liquefy and fuse with the stones in the salvaged asphalt and the new materials. Heating is continued until the mixture travels to an output port 37 to come out as 100% rejuvenated asphalt.

The meritorious features of the present invention is to combine the two sets of conventional equipment required for making asphalt and reclaiming asphalt and to use inexpensive conventional burners to dispense with the need to use the burners to generate high heat instantly to heat the stones directly. The present invention utilizes heat recovery to perform a secondary heating step and a double-layer gyroscopic drying machine to simplify the process steps and achieve an asphalt reclamation rate of 100%. In addition, the equipment costs are reduced, and exhaust discharge is lowered, thereby avoiding environmental pollution.

Although the present invention has been illustrated and described with reference to the preferred embodiment thereof, it should be understood that it is in no way limited to the details of such embodiment but is capable of numerous modifications within the scope of the appended claims.

What is claimed is:

1. A process for reclaiming salvaged asphalt, comprising the steps of:

calculating a certain proportion of parts of new sands, stones and tar to be added to a mixture of asphalt salvaged from roads and salvaged construction materials comprising mixtures containing sand, stones, water moisture and tar according to the proportion of stones, sands and tar in new asphalt product; adding the proportionally added new materials to the salvage and mixing them; transporting the mixture via a conveyor belt and feeding the mixture via a feed port into a double-layer drying machine (3);

after the mixture has entered a gyroscopic drum constituting the inner layer of the double-layer drying machine, using a plurality of burners disposed outside the drying machine to indirectly heat and bake the mixture to get rid of the moisture content in the mixture;

discharging the heat generated during the indirect heating through a discharge outlet and recovering the heat by means of a draft tube; and introducing the recovered heat once again into the drying machine via a heat energy inlet at the other end to heat the moisture, the tar in the mixture beginning to soften after a temperature of about 80° C has been reached; and mixing the salvaged asphalt and the new materials to form rejuvenated asphalt product when the salvaged asphalt and the softened tar travel to the outer gyroscopic drum, and when the burner (6) has been heated to 160° C. so that the sands and stones contained in the salvaged asphalt in the outer gyroscopic drum also reach 160° C. to be able to fuse with the liquefied tar.

2. A process for reclaiming salvaged asphalt as defined in claim 1, wherein the double-layer drying machine is internally provided with the outer and inner gyroscopic drums, and is externally provided with the burners, the heat energy discharge port, the draft tube, and the heat energy inlet, whereby the burners heat the drying machine from outside to perform the indirect heating and baking step, the draft tube permitting recovery of the generated heat to be introduced once again into the drying machine for secondary heating.

* * * * *